US008403733B2

(12) United States Patent
Klein et al.

(10) Patent No.: US 8,403,733 B2
(45) Date of Patent: Mar. 26, 2013

(54) METHOD OF COUPLING A HONING TOOL TO A HONING SPINDLE, HONING SPINDLE, HONING TOOL AND HONING DEVICE

(75) Inventors: Henning Klein, Stuttgart (DE); Jochen Brandstetter, Kirchheim (DE); Thomas Kegler, Nuertingen (DE)

(73) Assignee: KADIA Produktion GmbH + Co. (DE)

( * ) Notice: Subject to any disclaimer, the term of this patent is extended or adjusted under 35 U.S.C. 154(b) by 1051 days.

(21) Appl. No.: 12/224,066

(22) PCT Filed: Jan. 30, 2007

(86) PCT No.: PCT/EP2007/000755

§ 371 (c)(1),
(2), (4) Date: Sep. 8, 2008

(87) PCT Pub. No.: WO2007/093275

PCT Pub. Date: Aug. 23, 2007

(65) Prior Publication Data

US 2009/0270020 A1 Oct. 29, 2009

(30) Foreign Application Priority Data

Feb. 13, 2006 (DE) ..... 10 2006 007 704

(51) Int. Cl.
*B23C 5/26* (2006.01)

(52) U.S. Cl. ..... 451/470; 279/2.1; 451/464; 451/478; 451/485

(58) Field of Classification Search ..... 279/2.1, 279/2.11, 2.13, 145; 408/239 R; 451/464, 451/470, 471, 472, 473, 475, 478, 479, 480, 451/481, 482, 484, 485
See application file for complete search history.

(56) References Cited

U.S. PATENT DOCUMENTS 3,496,678 A 2/1970 Engle
3,622,169 A * 11/1971 Koch et al. ..... 279/76
4,906,147 A * 3/1990 Friesinger et al. ..... 409/232
(Continued)

FOREIGN PATENT DOCUMENTS

CH 242891 6/1946
DE 19 92 336 U 8/1968
(Continued)

OTHER PUBLICATIONS

Examination Report of Germany Patent Office dated Oct. 12, 2006 (6 pages).

(Continued)

*Primary Examiner* — Timothy V Eley
(74) *Attorney, Agent, or Firm* — Akerman Senterfitt

(57) ABSTRACT

The invention relates to a method of coupling a honing tool (2) to a honing spindle (1), a honing spindle suitable therefor, a honing tool suitable therefor and a honing device comprising a honing spindle and a honing tool. According to the invention, a method of coupling a honing tool to a honing spindle is proposed which has the following steps: inserting the honing tool into the honing spindle into a joining position in which a honing-tool centre axis (24) is oriented coaxially to the honing-spindle centre axis (23); locking the honing tool on the honing spindle in the joining position by actuating an adjusting device (5, 6) assigned to the honing spindle. Furthermore, a honing spindle, a honing tool and a honing device which are suitable for carrying out the method are provided.

17 Claims, 6 Drawing Sheets

U.S. PATENT DOCUMENTS

Figure 1:
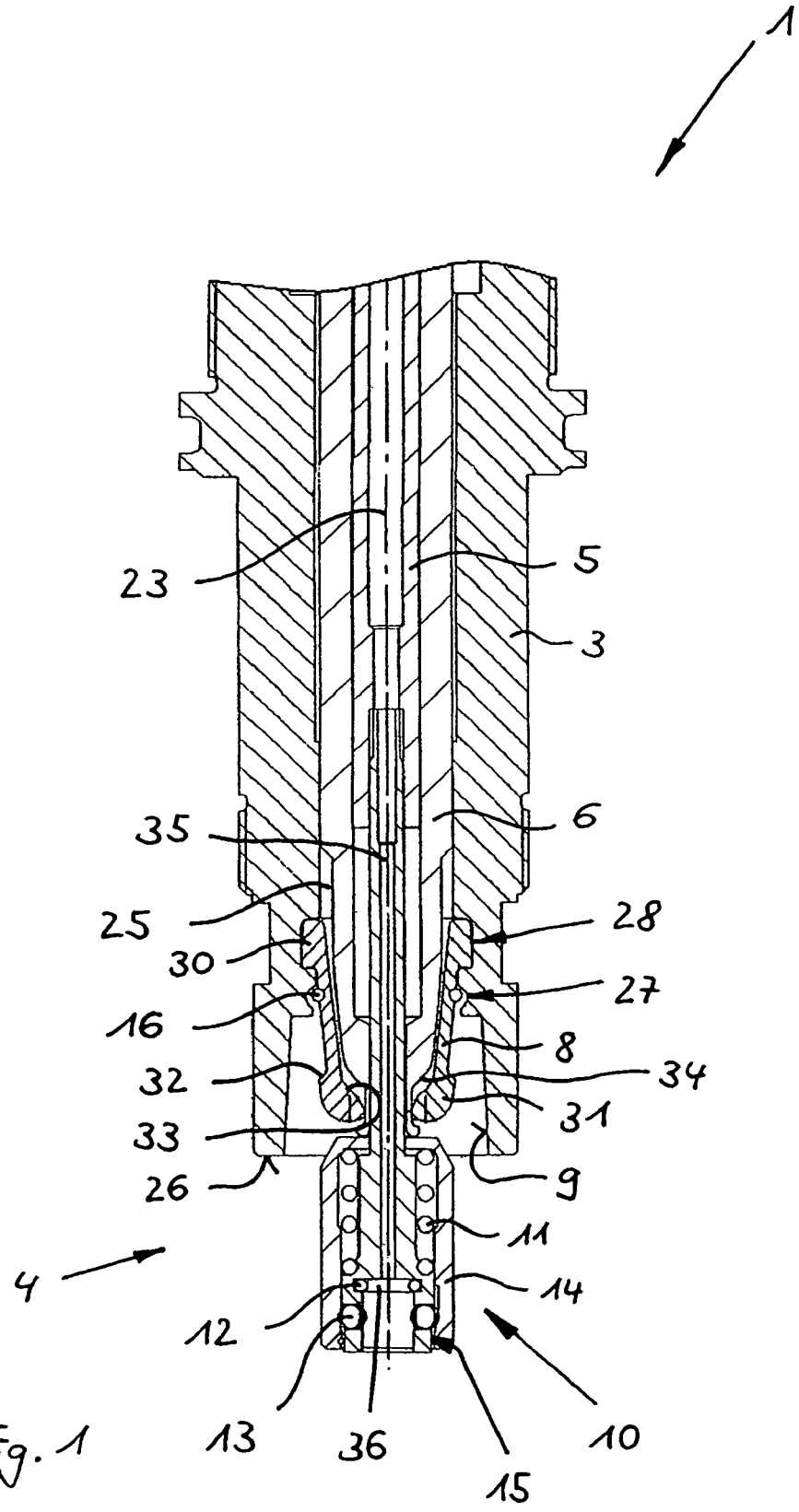

| | | | | |
|---|---|---|---|---|
| 5,269,103 | A * | 12/1993 | Nagel et al. | 451/8 |
| 5,800,252 | A * | 9/1998 | Hyatt | 451/61 |
| 5,988,957 | A * | 11/1999 | Wheeler | 408/239 R |
| 6,939,213 | B2 * | 9/2005 | Lovchik et al. | 451/360 |
| 7,189,143 | B2 | 3/2007 | Klein | |
| 7,387,479 | B1 * | 6/2008 | Lee | 409/232 |
| 8,029,340 | B2 * | 10/2011 | Henning et al. | 451/359 |
| 2006/0052038 | A1 | 3/2006 | Klein | |

FOREIGN PATENT DOCUMENTS

| | | | |
|---|---|---|---|
| DE | 1 577 408 | A1 | 1/1970 |
| DE | 1 920 034 | A1 | 10/1970 |
| DE | 24 50 323 | A1 | 5/1976 |
| EP | 1 616 665 | A1 | 1/2006 |
| GB | 513 649 | A | 10/1939 |
| JP | 60-217059 | A | 10/1985 |
| JP | 2-232135 | A | 9/1990 |
| JP | 3-234462 | A | 10/1991 |
| JP | 7-314273 | A | 12/1995 |
| JP | 8-216015 | A | 8/1996 |
| JP | 2000-190198 | A | 7/2000 |
| JP | 2001-018148 | A | 1/2001 |
| JP | 2004-223697 | A | 8/2004 |
| JP | 2005-211995 | A | 8/2005 |
| WO | WO 03/103896 | A1 | 12/2003 |

OTHER PUBLICATIONS

Form PCT/ISA/220 Notitication of Transmittal of International Search Report (2 pages).

Form PCT/ISA/210 International Search Report dated May 21, 2007 (5 pages).

Form PCT/ISA/237 Written Opinion of international Searching Authority (6 pages).

Translation of Excerpt Office Action dated May 29, 2012 issued in connection with corresponding Japanese Patent Application No. 2008-553652.

* cited by examiner

METHOD OF COUPLING A HONING TOOL TO A HONING SPINDLE, HONING SPINDLE, HONING TOOL AND HONING DEVICE

The invention relates to a method for coupling a honing tool to a honing spindle, a honing spindle suitable for this, a honing tool suitable for this and a honing device having a honing spindle and a honing tool.

Honing tools are used for the precise working of preferably cylindrical inner or outer surfaces and to this end are coupled to a honing spindle, which is typically part of a honing machine. The honing spindle is able to transmit forces and torques to the honing tool in order to carry out the desired surface working.

For a flexible use of the honing device it is known to provide a coupling device between the honing spindle and honing tool so as to permit a replacement of the honing tool. It must be borne in mind that typical honing tools are provided on an end remote from the honing spindle with at least one cutting material body, which during surface working is pressed with a contact pressure onto the surface. The contact pressure is typically transferred from a feed member provided in the honing spindle to a compression member in the honing tool and from there to the cutting material body. In this case a force-transmitting connection between the feed member and the compression member must also be detachably constructed in order to permit a replacement of the honing tool.

In order to be able to ensure the precision of the surface working necessary in a honing process, high demands are made on the detachable connection between honing spindle and honing tool. These requirements more particularly apply to the concentricity tolerance of the honing tool relative to the honing spindle centre axis. To ensure a high concentricity tolerance it is known to terminally construct the honing spindle with a cylindrical, precision-ground surface and to provide a chuck with a corresponding hole and which can be interconnected in the manner of a plug connection. To ensure a reliable plug connection, an inner wall of the hole in the chuck can be deformed by a hydrostatic clamping device integrated into the chuck, so that the honing tool can be fixed in centred manner to the honing spindle. A coupling of the compression member to the honing spindle is implemented in the case of a known honing tool by a bayonet catch. For coupling the honing tool an operator must initially manually lock the bayonet catch of the compression member and then the honing tool can be fixed to the honing spindle by actuating the hydrostatic clamping device.

A problem of the invention is to provide an improved method for coupling a honing tool to a honing spindle. The particular aim is to permit an automation of the tool change. Further problems of the invention are the creation of an improved honing spindle and an improved honing tool, which in particular permit the use of the method.

These and further problems are solved by a method having the features of claim 1, a honing spindle having the features of claim 14 and a honing tool having the features of claim 29. Advantageous developments are given in the dependent claims. By express reference the wording of all the claims is made into part of the content of the description.

According to a first aspect of the invention a method for coupling a honing tool to a honing spindle is provided, which has the following steps: inserting the honing tool in the honing spindle in a joining position, where a honing tool centre axis is oriented coaxially to the honing spindle centre axis; locking the honing tool to the honing spindle by actuating an adjusting device associated with the honing spindle. At least in the end phase of the insertion movement, honing tool insertion into the honing spindle is normally brought about by a translatory movement parallel to the honing spindle centre axis until the function position is reached.

The decisive point during the performance of the method is the actuation of an adjusting device associated with the honing spindle for locking the honing tool. The adjusting device interacts with coupling structures of the honing tool and honing spindle in such a way that at the end of the coupling process a precise, stable coupling of the honing tool coaxially to the honing spindle is ensured. In view of the fact that in each case the honing tool is changed, the association of the coupling device with the adjusting device of the honing spindle leads to a more cost favourable implementation of tool clamping, because an expensive adjusting device is avoided on the honing tool, without having to take into consideration scum in connection with the precision of the coupling of the honing tool to the honing spindle.

Preferably the actuation of the adjusting device can be carried out automatically by means of a control unit of a honing machine with which the honing spindle is typically associated. Moreover through the association of the adjusting device with the honing spindle the provision of external forces, e.g. in the form of electrical or hydraulic energy, for actuating the adjusting device is facilitated, because such external forces are in any case necessary for honing machine operation. The honing tool can be brought into the joining position manually by a user or in automated manner by a handling device. The further joining process for locking the honing tool to the honing spindle can be initiated and/or performed manually or automatically.

In a development of the invention the adjusting device is moved along the honing spindle centre axis. The honing spindle is typically a slender, columnar structure. As a result of the configuration of the adjusting device in such a way that the adjusting movement is carried out along the honing spindle centre axis, it is possible to ensure that there is no change to the cross-section of the columnar honing spindle in a cross-sectional plane orthogonal to the honing spindle centre axis as a result of the integration of the adjusting device. Thus, as a result of the adjusting device being movable longitudinally and in particular parallel to the honing spindle centre axis, an automatable, but still slender design of the coupling structures of the honing tool and honing spindle is made possible.

According to a further development of the invention, the locking of the honing tool to the honing spindle and the coupling of the feed member to the compression member is brought about by a single operating movement of the feed member in the direction of the honing tool. The operating movement of the feed member also results in the adjusting movement of the adjusting device. Preferably the translatory movement of the adjusting device is brought about by the feed member movement. For example, an energy storage device associated with the adjusting device and which is pretensioned in the direction of the honing tool for the adjusting movement, is released by the movement of the feed member in the direction of the honing tool so as to permit the coupling of said honing tool to the honing spindle. In a particularly preferred manner the adjusting movement of the adjusting device and also the feed member movement takes place in the direction of the honing tool. This leads to a particularly advantageous design of the honing spindle, because the movement directions of feed member and adjusting device are similar or identical and there need be no deflection of movements in order to ensure an at least sectionwise coupling of individual movements. As a result of the adjusting movement of the adjusting device it is possible to actuate at least one locking device for a positive connection of the honing tool to the honing spindle. The locking device can in particular be designed for exerting a force on the honing tool directed towards the honing spindle, in order to ensure a particularly firm and reliable coupling of the honing tool. Preferably the locking device is provided for a positive coupling of the honing tool to the honing spindle.

In a further development of the invention, on locking the honing tool to the honing spindle there is a locking of the honing spindle feed member to a honing tool compression member. The locking of the compression member to the feed member can take place simultaneously or also earlier or later than the adjusting movement of the adjusting device. Preferably locking is automatic or automatable, so that no action on the part of the operator is needed for coupling the honing tool. This permits a completely automated sequence of coupling and uncoupling honing tools with respect to honing spindles, which leads to greater economic efficiency for a honing machine equipped in this way.

According to a further development of the invention for coupling the feed member to the compression member it is merely necessary to have a translatory movement of the feed member in the direction of the compression member, without requiring a relative rotation between feed member and compression member for bringing about the force-transmitting coupling, which simplifies automation of the coupling operation.

As a result of the coupling of the feed member to the compression member there is a preferably clearance-free, tension and compression loadable coupling of these parts, so that even with the axially oscillating honing tool movements characteristic of honing operations it is still possible to achieve a highly precise control of the honing working, particularly the position of the honing strips and/or the contact pressure of the honing strips on the surface to be worked.

In a further development of the invention when the feed member strikes the compression member there is a movement of a coupling sleeve relative to the feed member as a result of which at least one coupling member is locked, more particularly radially and in force-transmitting manner to the compression member. The coupling sleeve and/or feed member can be provided with at least one control surface bringing about a coupling member movement due to the relative movement between coupling sleeve and feed rod and which in turn ensures a positive coupling of compression member to feed member. The coupling member preferably engages in an undercut area, especially a recess, on the feed member and/or compression member. Preferably the at least one coupling member and the corresponding recess are so designed that there is a self-retention of the positive connection. In the case of a rise in the forces to be transmitted via the coupling member and recess, there is also a rise in the locking forces, so that the connection between coupling member and recess automatically tightens.

In a further development of the invention the relative movement of the coupling sleeve is brought about by an energy storage device, which is released by a movement of the feed member relative to the adjusting device. This makes it possible to implement a simple construction of the coupling structure between feed member and compression member, which ensures a reliable locking or, in the case of an opposing movement of the feed member, also a reliable unlocking of the coupling structure. The energy storage device is preferably a helical spring, which permits a storage of an amount of energy adequate for locking and unlocking in a small, cylindrical volume section, which can advantageously be provided between feed member and coupling sleeve.

According to a further development of the invention, on coupling the feed member to the compression member a sealed, communicating connection is produced between fluid channels of the feed member and compression member. Through a fluid channel supplied by the honing machine with one or more gaseous and/or liquid fluids, particularly honing oil and which extends along the honing spindle and honing tool and typically issues in the vicinity of the honing strips into the environment, it is possible to ensure an advantageous supply of the honing strips with a coolant and/or lubricant.

According to another aspect of the invention a honing spindle has a shank for transmitting forces and torques to a honing tool body. With the shank is associated a feed member for providing an actuating force on a compression member of the honing tool. Terminally on the shank is provided a tool carrier, which is designed for a detachable coupling of the honing tool, at least one adjusting device being associated with the tool carrier and which is constructed for securing the tool member to the shank. An in particular automatable securing of the tool member of the honing tool to the shank by means of an adjusting device associated with said shank permits an advantageous replacement of honing tools, because all the sequences relating to honing tool coupling can be carried out by manipulations on or in the honing spindle and no synchronization is necessary with an external actuating device, as would be the case when adjusting movements were exerted on the honing tool. This permits an advantageous synchronization and integration of the coupling or uncoupling process with the further process steps occurring during honing.

According to a further development of the invention the tool carrier has at least one, at least zonally conically designed recess for receiving a correspondingly shaped coupling section of the honing tool. This permits a highly precise and cost effectively producible coupling structure between honing tool and honing spindle. In particular, the tool carrier of the honing spindle can be designed for receiving a coupling section of the honing tool in the form of a hollow shank taper (HST). The conical coupling structures on the honing spindle and honing tool can be designed in largely self-centering manner, so that through the insertion of the honing tool into the recess of the honing spindle there is a precentring with a substantially or completely coaxial orientation of honing spindle centre axis and honing tool centre axis and optionally also a prefixing of the honing tool.

According to a further development of the invention the adjusting device is provided for a deflection of at least one locking element associated with the tool carrier and which is designed for locking the tool body to the shank. The locking element brings about a positive connection between honing tool and honing spindle. For this purpose the locking element is deflected by the adjusting device from a rest position into a locking position in which it engages in the honing tool, particularly in an undercut recess thereof. To this end the adjusting device can bring about the desired locking by a translatory movement towards the honing tool and a cancelling out of the locking effect for uncoupling the honing tool takes place through an opposing adjusting movement of the adjusting device.

In a further development of the invention the locking element at least substantially extends along the honing spindle centre axis and in each case has terminally provided projections for positive locking on the shank and/or honing tool, the projections being in particular paddle-shaped. Through the locking element extending along the honing spindle centre axis a particularly slender honing spindle design can be obtained. The terminal locking element projections allow the desired positive coupling of the tool body and the projections facing said tool body can be provided with inclined surfaces, which in the case of a locking movement brought about by the adjusting device and which can be substantially radially, i.e. orthogonally to the honing spindle centre axis, can bring about a honing tool movement towards the honing spindle. Thus, the centering action of the conical coupling structures on honing tool and honing spindle is intensified and frictional engagement of the conical coupling structures increased.

According to another aspect of the invention a honing tool for performing a honing process on a workpiece has a tool body and at least one cutting material body movably fitted relative to the tool body, together with a compression member, which for controlling the honing strip is movable along a centre axis of the tool body and which is provided with a coupling device for a detachable, force-transmitting connection to a feed member of a honing spindle. On its end region remote from the cutting material body the tool body has an at least zonally truncated cone-shaped coupling section for coupling to a correspondingly shaped tool carrier of the honing spindle. Compared with conventional honing tools and for the same or an improved precision, such a honing tool can be manufactured less expensively, because only coupling structures for the tool body and compression member have to be provided. In addition, such a honing tool can be replaced in automated manner, which decisively improves the implementation of a honing method, because a rapid and reliable honing tool change can be carried out without an operator being involved. This is particularly important in mass production, because the honing machine can contain a magazine with several honing tools to which e.g. ready access is possible in the case of the honing tool being used becoming worn.

In a further development of the invention the zonally conical coupling section is constructed as a hollow shank taper. A hollow shank taper provides a highly precise tool interface, which is e.g. fundamentally known from the field of milling tools and which can therefore be inexpensively manufactured using established production processes. Considerable experience already exists regarding the design of the hollow shank taper and this can at least partly be used for the specific demands of the honing method.

According to another aspect of the invention a honing device with an inventive honing spindle according to one of the claims and an inventive honing tool are provided. The honing device, which in particular is constructed as a honing machine with a honing drive, one or more feed mechanisms for moving the honing spindle and feed member and a machine control for influencing the feed mechanisms, permits the working of surfaces with honing tools according to the invention.

Further advantages and features of the invention can be gathered from the claims and the following description of a preferred embodiment relative to the attached drawings, wherein show:

FIG. 1 A sectional representation of an embodiment of an inventive honing spindle with a conical section-shaped tool carrier for a honing tool.

Figure 2:
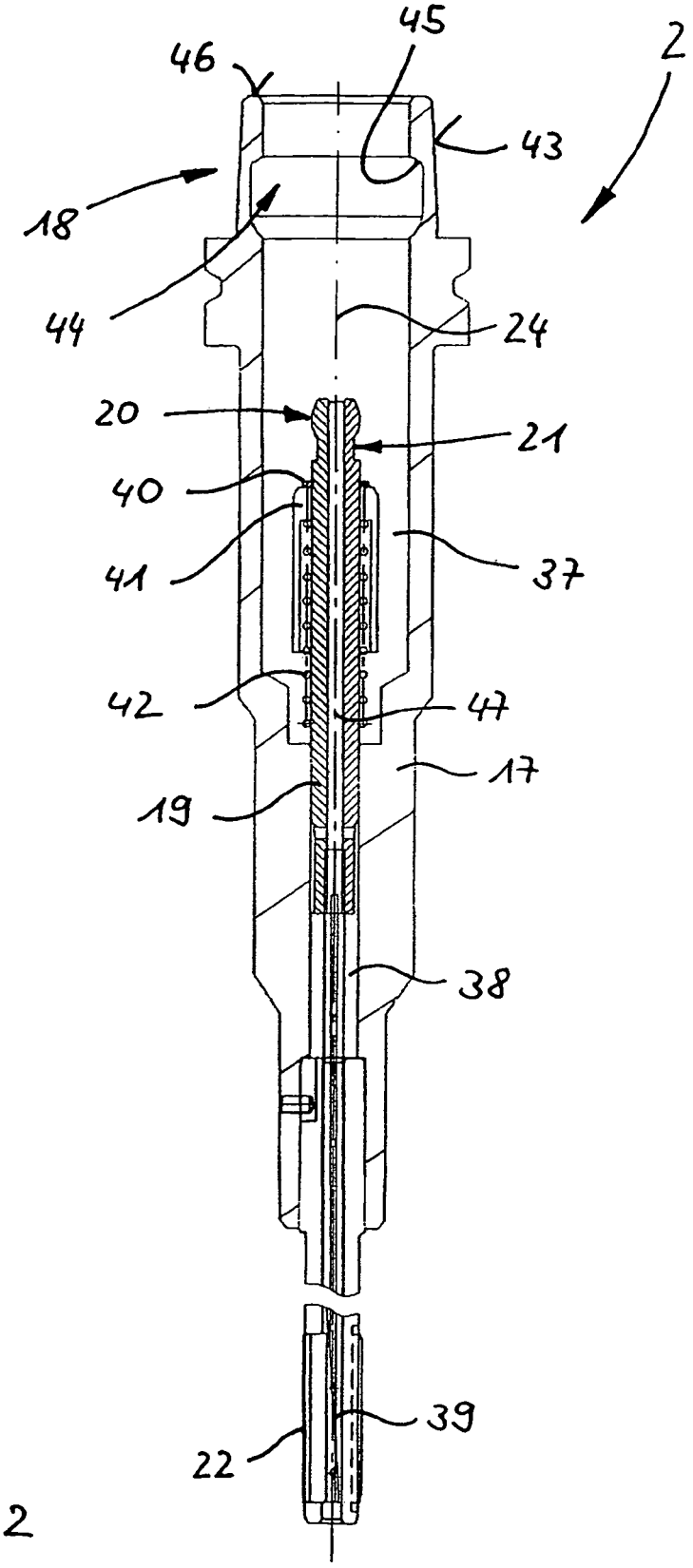

FIG. 2 A sectional representation of a honing tool with a conical section-shaped coupling structure adapted to the honing spindle of FIG. 1.

Figure 3:
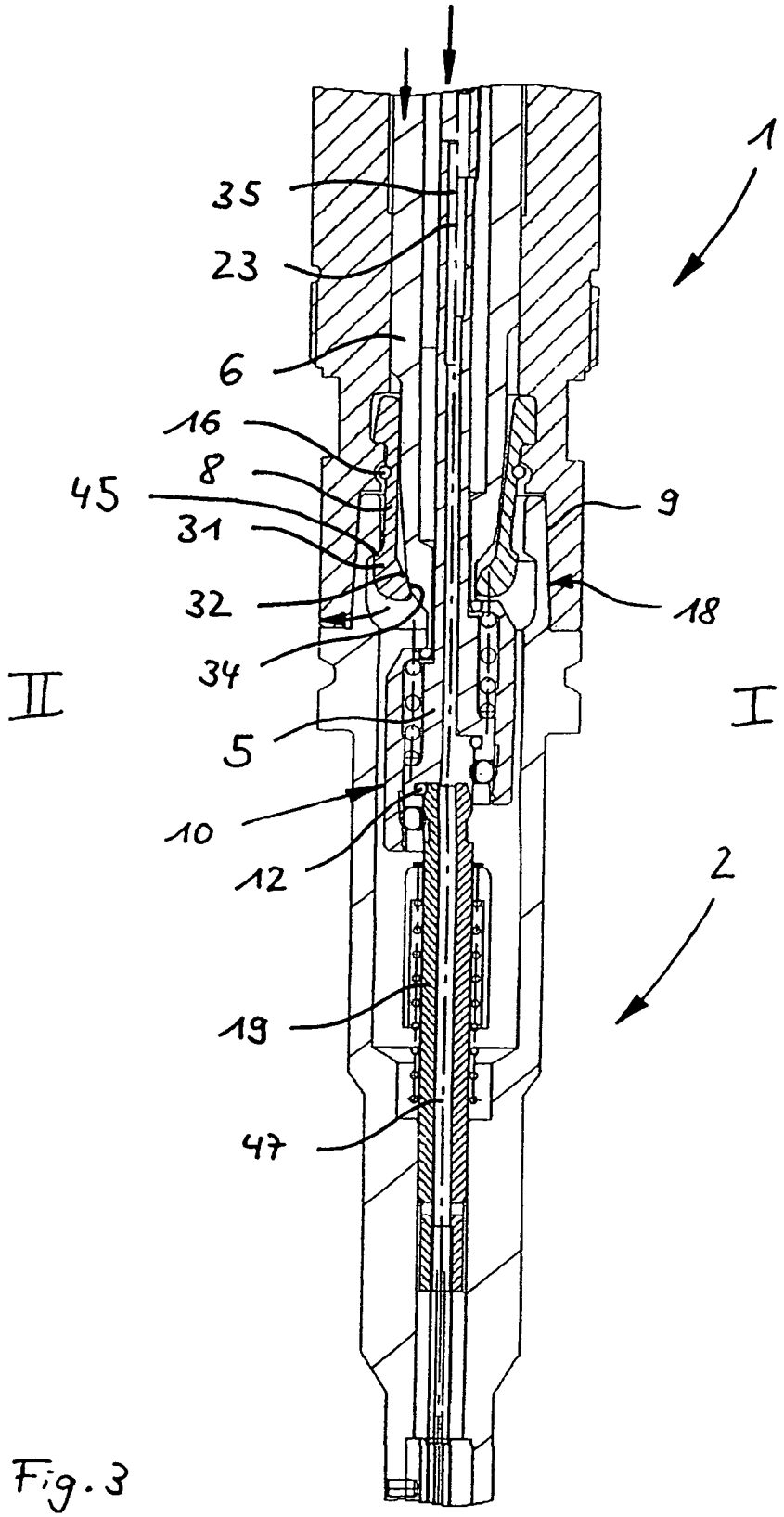

FIG. 3 The honing spindle according to FIG. 1 and honing tool according to FIG. 2 in in each case a half sectional representation for a first and a second coupling phase.

Figure 4:
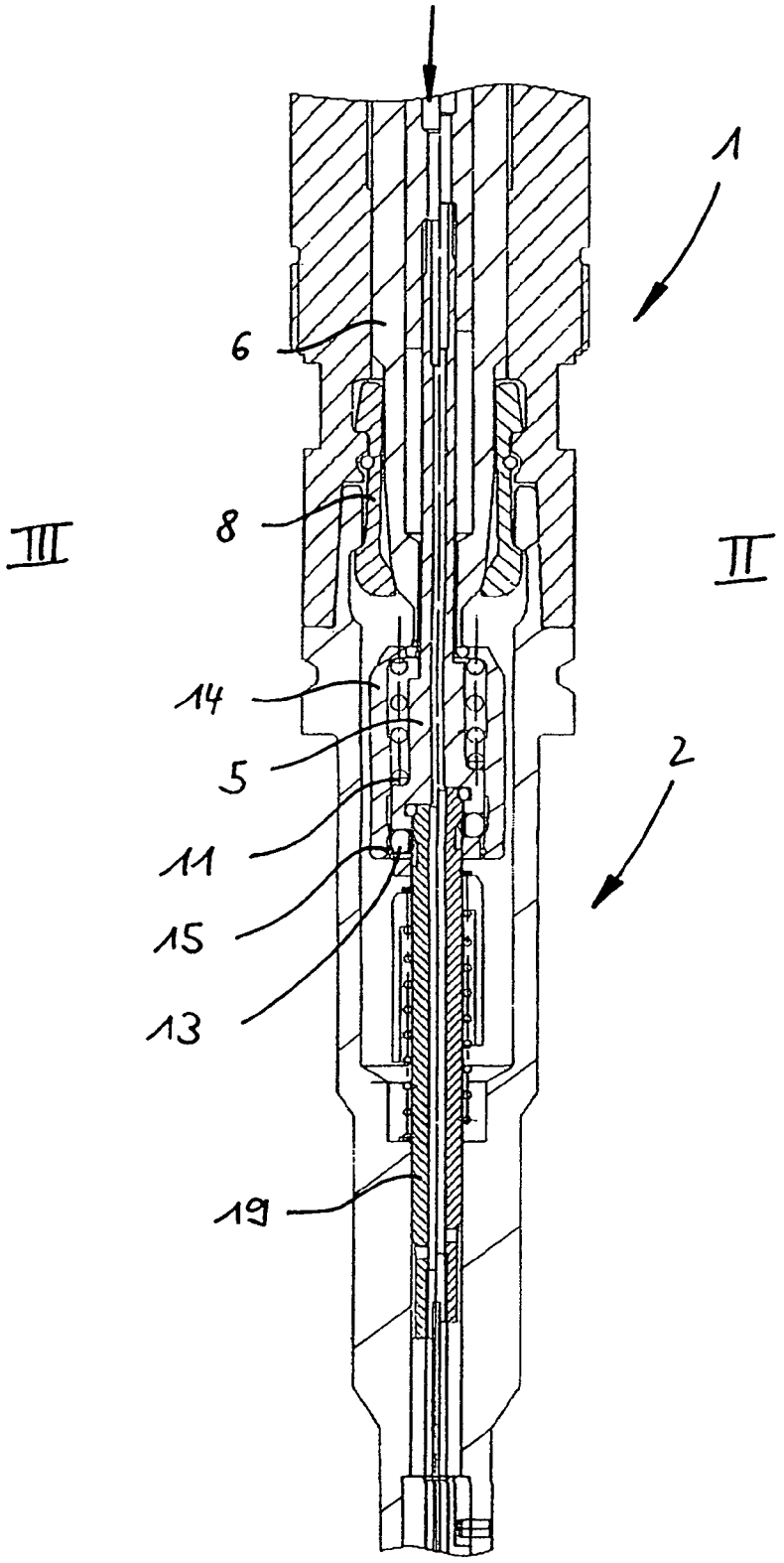

FIG. 4 The honing spindle of FIG. 1 and honing tool according to FIG. 2 in an in each case half sectional representation for the second and third coupling phase.

Figure 5:
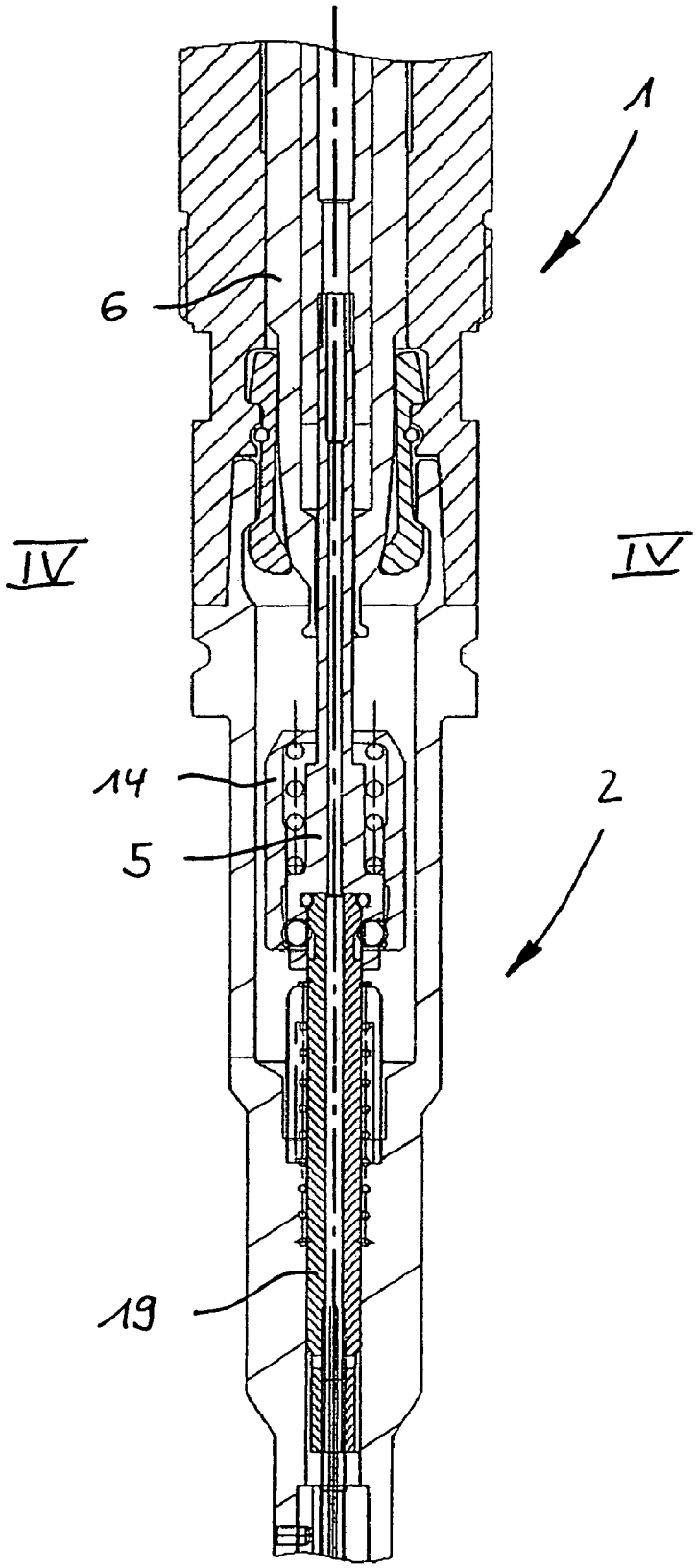

FIG. 5 The honing spindle of FIG. 1 and honing tool of FIG. 2 in a completely coupled configuration.

Figure 6:
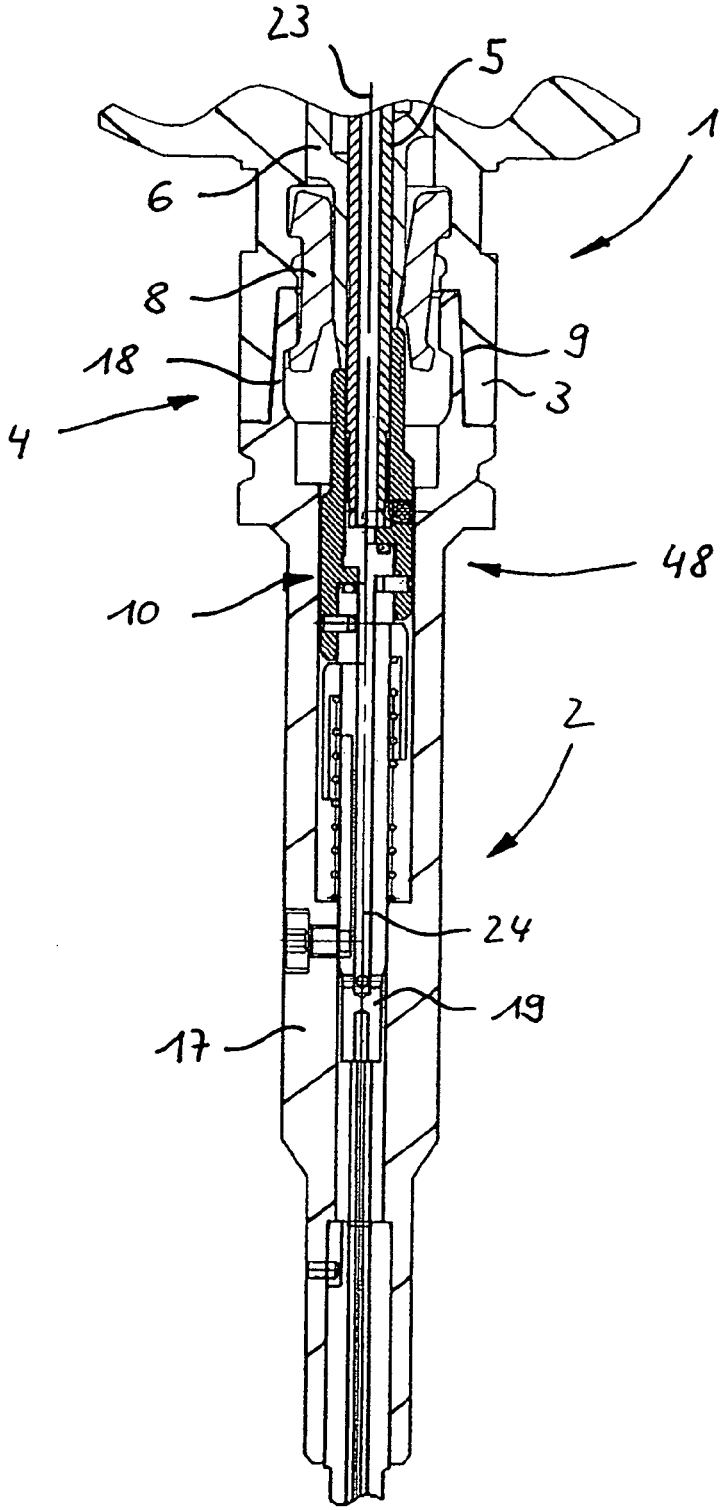

FIG. 6 A second embodiment of a honing spindle and a honing tool coupled thereto with a bayonet catch between feed member and compression member.

A honing spindle 1 shown in the neutral or rest position in FIG. 1 has a tubular, hollow cylindrical shank 3, which is coupled to a not shown drive mechanism of a honing machine, in order to transmit forces and torques and therefore translatory and rotary movements to a honing tool. At the lower end of honing spindle 1 according to FIG. 1 is provided a tool carrier 4, which is used for coupling a honing tool 2 shown in greater detail in FIGS. 2 to 5.

A cylindrically shaped feed member 5 and a control tube 6 embracing in sleeve-like manner said feed member 5 are located in a honing spindle hole 25, provided concentrically to a honing spindle centre axis 23 in shank 3. Feed member 5 and control tube 6, which serves as an adjusting device or as part of a control device, are movable relative to one another with respect to shank 3 and can be displaced along the honing spindle centre axis 23. In a not shown area of shank 3, an energy storage device in the form of a helical spring associated with the control tube 6 and which is pretensioned in the rest position shown exerts a force on control tube 6 in the direction of tool carrier 4.

In the vicinity of the tool carrier 4 is provided a truncated cone-shaped recess in shank 3 in the form of a conical receptacle 9 and which is widened towards an end face 26 of shank 3 and to which, in the direction of the honing spindle hole 25, are connected several, in each case circumferentially constructed projections defining a spring notch 27 and a locking notch 28. End face 26 and conical receptacle 9 are implemented with a precisely produced surface, which is oriented as accurately orthogonally or concentrically as possible to the honing spindle centre axis 23 and which are constructed for the accurate concentricity coupling of the honing tool 2. A cone angle and a central cone diameter are preferably defined according to DIN 69063, which establishes the reception geometry for hollow shank tapers according to DIN 69893.

Control tube 6 and conical receptacle 9, as well as the spring notch 27 and locking notch 28 define a profiled annulus, in which are received in circular, circumferential manner with an angular spacing of 60ø six locking elements in the form of coupling hooks 8. In the rest position according to FIG. 1, the coupling hooks 8 extend at least roughly parallel to the honing spindle centre axis 23 and in each case have terminal projections 30, 31, which are shaped in the manner of a paddle surface for a boat paddle. The six circularly arranged coupling hooks 8 are pressed by a circumferential spring ring 16 radially inwards against the control tube 6 and are positively movably received in locking notch 28 with projections 30 remote from the tool carrier 4. In the end region facing tool carrier 4, the coupling hooks have a projection 31, which is provided with an inwardly directed inclined surface 33 and an outwardly directed inclined surface 32. The inwardly directed inclined surface 33 is designed for an operative connection with a conically shaped control surface 34 of control tube 6 and in the case of a translatory movement of control tube 6 towards the tool receptacle, permits a radially outwardly directed pivoting movement of the downwardly projecting, free ends 31 of coupling hooks 8. The outwardly directed inclined surfaces 32 are provided for a subsequently described interaction with an inclined surface 45 of honing tool 2, in order to draw the latter into the tool carrier.

The feed member 5 is constructed in two parts and has a drive-side, upper part and a lower part screwed to the upper part and which on its end region in the tool carrier 4 has a two-stage, cylindrical thickening, a hole provided in said thickening forming the compression member receptacle 10. To said compression member receptacle 10 is connected a fluid hole 35 serving as a fluid channel and which extends along the entire length of the feed member 5 and is used for supplying the compression member 19 with a fluid, particularly a honing oil. On an end face of the compression member receptacle 10 is provided a circumferential sealing groove 36 for receiving a coupling seal 12 in the form of an 0-ring. The thickening is surrounded by a coupling sleeve 14, which moves relative to the feed member 5 and as a result of the two-stage design of the thickening an annular end face is made available and serves as a bearing face for a coupling spring 11. In the shown rest position of honing spindle 1, coupling spring 11 is pretensioned by the action of control tube 6 and is supported on an inner face of coupling sleeve 14. In an end region of the compression member receptacle is provided orthogonally to the honing spindle centre axis 23 a crosshole in which is in each case inserted a coupling body in the form of a coupling ball 13. To prevent a dropping out of the coupling balls 13, the crosshole is in each case provided on an inner face of the compression member receptacle 10 with an impression reducing the diameter of the hole. In the radial outwards direction the movement of the coupling balls 13 is limited by the coupling sleeve 14 and engage on radially inwardly facing control surfaces 15 of coupling sleeve 14, which in each case form an acute angle with the honing spindle centre axis 23. Thus, with a translatory relative movement of coupling sleeve 14 with respect to the feed member 5, there can be a translatory, opposing movement of coupling balls 13 in the transverse direction to honing spindle centre axis 23.

The honing tool 2 shown in a neutral or rest position in FIG. 2 has a substantially rotationally symmetrically designed tool body 17. At the lower end of tool body 17, in accordance with FIG. 2 there is a slender, replaceable working shank, to which is fitted at least one cutting material body implemented as a honing strip 22. A truncated cone-shaped coupling section in the form of a hollow shank taper 18 is provided on an upper, thickened end region of tool body 17. The hollow shank taper 18, which can in particular be constructed according to DIN 69893, is provided with a substantially cylindrical coupling hole 37, which issues into a smaller diameter compression member hole 38. A substantially cylindrical compression member 19 is displaceably received in the compression member hole 38 and is provided in an end region adjacent to the honing strip 22 with an inclined surface 39, so that as a result of a translatory movement of the compression member 19 along a honing tool centre axis 24 it is possible to bring about a radial adjustment movement of the honing strip 22. The compression member 19 is provided with a fluid channel 47 extending along the honing tool centre axis 24 and which ensures a supply of honing strip 22, e.g. with honing oil. In an end region facing the hollow shank taper 18, the compression member 19 has a coupling collar 20, which passes axially into a coupling groove 21. Below the coupling groove 21 is provided a spring bell 41 axially secured by means of a circlip 40 and which embraces in sleeve-like manner a restoring spring 42 in the form of a helical spring. In the rest position according to FIG. the restoring spring 42 is relaxed and can be tensioned by applying a compressive force to the compression member 19 that is directed towards honing strip 22, so that on reducing the compressive force the feed force on the honing strip 22 is reduced.

In the vicinity of the truncated cone-shaped outer face 43 of the hollow shank taper 18 a circumferential locking groove 44 is made in the coupling hole 37 and has a conical section-shaped inclined surface 45 adjacent to the upper end face 46 of tool body 17 and which is designed for a positive engagement of the inclined surfaces 33 of coupling hooks 8.

A coupling process of honing tool 2 to honing spindle 1 takes place in several, subsequently described coupling phases, which pass continuously into one another, but which are shown in step-like form to facilitate understanding. FIGS. 3 and 4 in each case show as half-sections two different, time-succeeding coupling phases. The coupling phase shown in the left-hand half-section shown as later in FIG. 3 is identical to the representation of the coupling phase according to the right-hand half-section of FIG. 4, i.e. the in each case later coupling phase is shown in the left-hand half-section.

The coupling process begins with the honing tool 2 with its coupling section in the form of a hollow shank taper 18 being inserted in the truncated cone-shaped tool carrier 4 of honing spindle 1 either manually or with the aid of a suitable handling device. At least in the end phase of honing tool insertion a translatory movement of the honing tool 2 can take place substantially parallel to a honing spindle centre axis 23 until at the end of said first coupling phase (coupling phase 1) the honing tool 2 is in a joining position, where the honing tool centre axis 24 is oriented substantially or precisely coaxially to the honing spindle centre axis 24. In the joining position, which is shown in the right-hand half-section of FIG. 3 and which is subsequently referred to as coupling phase 1, initially there is only a positive conical connection between the conical receptacle 9 of honing spindle 1 and the hollow shank taper 18 of honing tool 2. In the joining position all the devices relating to the coupling operation of honing spindle 1 and honing tool 2 are in the rest positions according to FIGS. 1 and 2.

In the second coupling phase (coupling phase II), as shown in the left-hand half-section of FIG. 3, feed member 5 is moved along the honing spindle centre axis 23 downwards towards the honing tool 2. Thus, the control tube 6 which is pressed by the not shown energy storage device towards honing tool 2 can slide downwards synchronously with the feed member 5. During the translatory or adjusting movement of control tube 6, control faces 34 of control tube 6 engage on the inclined surfaces 33 of projections 31 of coupling hooks 8 and move the latter radially outwards. As the coupling hooks 8 are movable with the upper projections 30, but are positively received in the locking notch 28 and can here not implement any significant radial or axial movements, there is a pivoting movement of coupling hooks 8 about not shown pivoting axis oriented orthogonally to and spaced radially from the honing spindle centre axis 23 and which roughly touch spring ring 16. As a result of this pivoting movement the outer inclined faces 32 of the lower projections 31 come into positive operative connection with the circumferential inclined surface 45 of hollow shank taper 18. As a result of the operative connection an axial, upwardly directed force according to FIG. 3 is exerted on tool body 17, so that the latter is drawn into the conical receptacle 9 and as a result is coupled in centred, fixed manner. As soon as an equilibrium of forces is brought about between control tube 6, coupling hooks 8 and tool body 17, the control tube 6 comes to rest and an amount of energy stored in the not shown energy storage device of control tube 6, i.e. a residual pretension, even in the case of dynamic shock loads along the honing spindle centre axis 23 ensures a reliable locking of the coupling hooks.

As a result of the movement of feed member 5 the compression member receptacle 10 is linked with compression member 19, but there is still no locking in the coupling phase II. Instead the coupling seal 12 rests on a chamfered end face of compression member 19 and provides a sealing connection of fluid hole 35 and fluid channel 47.

In coupling phase III, as shown in the left-hand half-section of FIG. 4, there is a further infeed of feed member 5 towards honing tool 2. As further movement towards honing tool 2 of control tube 6 is prevented by the positive coupling of the coupling hooks 8, the coupling sleeve 14 coupled with the feed member 5 also moves away from control tube 6. As a result the energy stored in coupling spring 11 can be released and leads to a relative displacement of coupling sleeve 14 counter to the movement direction of feed member 5. As a result of this relative movement the coupling balls 13 are moved radially inwards by means of control faces 15 and as a result of the engagement in ring groove 21 positively lock the compression member 19 to feed member 5. Coupling spring 11 like the energy storage device of control tube 6 is selected in such a way that in the locking position there is still an adequate pretension or residual energy quantity to ensure a reliable locking, even if shock loads occur. This creates a clearance-free, tension and pressure loadable coupling of compression member to feed member.

In coupling phase IV, as shown in FIG. 5, there is a complete coupling of tool body 17 to shank 3 of honing spindle 1 and a complete coupling of compression member 19 to feed member 5. The entire coupling process was solely defined by a translatory movement, namely by the continuous advance of feed member 5 towards honing tool 2. For coupling the compression member and feed member no relative rotation of these two components is necessary. The movements of control tube 6 and coupling sleeve 14 taking place relative to the feed member are brought about by energy storage devices, but could also be brought about by adjusting devices, e.g. a hydraulic piston.

An uncoupling process of honing tool 2 with respect to honing spindle 1 takes place in the reverse order of the above-described coupling phases and exclusively as a result of the retraction of the feed member 5 there is initially an entrainment of the coupling sleeve 14, which engages with the control tube 6, so that there is a relative movement of coupling sleeve 14 with respect to feed member 5 and the coupling spring 11 is tensioned and the coupling balls 13 are unlocked from the coupling groove 21 of compression member 19. Through further retraction of feed member 5 and as a result of positive engagement of control tube 6 on coupling sleeve 14, the locking of coupling hooks 8 to hollow shank taper 18 is released and the honing tool 2 is freed from the conical receptacle 9 and can be removed downwards either manually or in automated manner by drawing away.

In the embodiment of FIG. 6, in place of the automated couplable connection between compression member 19 and feed member 5, there is a preferably manually lockable bayonet catch. Coupling of tool body 17 to shank 3 takes place in the manner described hereinbefore by a movement of control tube 6.

The invention claimed is:

1. A method for coupling a honing tool to a honing spindle comprising the steps of:

inserting the honing tool in the honing spindle in a joining position where the honing tool center axis is oriented coaxially to the honing spindle center axis, and locking the honing tool on the honing spindle by actuating an adjusting device associated with the honing spindle, wherein the step of locking the honing tool on the honing spindle includes coupling a feed member of the honing spindle to a compression member of the honing tool, and wherein a connection which is clearance-free and is loadable in tension as well as in compression is obtained upon coupling the feed member of the honing spindle to the compression member of the honing tool.

2. The method according to claim 1, wherein the locking of the honing tool to the honing spindle and the coupling of the feed member to the compression member are brought about by a single operating movement of the feed member in the direction of the honing tool.

3. The method according to claim 1, wherein the coupling of the feed member of the honing spindle to the compression member of the honing tool is exclusively brought about by a translatory movement of the feed member in the direction of the compression member without any relative rotation between the feed member and the compression member.

4. The method according to claim 1, wherein a translatory movement of the adjusting device is brought about by a movement of the feed member.

5. The method according to claim 1, wherein the locking of the feed member to the compression member is brought about by a translatory movement of the feed member relative to the compression member.

6. The method according to claim 1, wherein on coupling the feed member to the compression member, a sealed, communicating connection is generated between a fluid channel of the feed member and a fluid channel of the compression member.

7. The method according to claim 1, wherein the adjusting device is moved along the honing spindle center axis.

8. The method according to claim 1, wherein the adjusting device is moved in the direction of the honing tool for locking the honing tool on the honing spindle.

9. The method according to claim 1, wherein through an adjusting movement of the adjusting device, at least one locking device is actuated for a positive connection of the honing tool to the honing spindle.

10. A method for coupling a honing tool to a honing spindle comprising the steps of:

inserting he honing tool in the spindle in a joining position where the honing tool center axis is oriented coaxially to the honing spindle center axis, and locking the honing tool on the honing spindle by actuating an adjusting device associated with the honing spindle, wherein the step of locking the honing tool on the honing spindle includes coupling a feed member of the honing spindle to a compression member of the honing tool, and wherein a movement of a coupling sleeve relative to the feed member is effected when the feed member impacts on the compression member so that, as a result thereof, the coupling member is locked in a force-transmitting manner to the compression member.

11. The method according to claim 10, wherein the relative movement of the coupling sleeve is brought about by an energy storage device which is released by a movement of the feed member relative to the adjusting device.

12. The method according to claim 11, wherein energy stored in the energy storage device is mechanically stored in a spring mechanism.

13. A honing tool for performing a honing process on a workpiece, comprising: a tool body; at least one cutting material body fitted in a movable manner relative to the tool body; and a compression member for controlling the cutting material body and which is movable along a center axis of the tool body and has a coupling device for a detachable, force-transmitting connection with a feed member of a honing spindle, wherein the tool body is provided on an end region remote from the cutting material body with an at least zonally truncated cone-shaped hollow shank taper coupling portion for coupling to a correspondingly shaped tool carrier of a honing spindle.

14. The honing tool according to claim 13, wherein the hollow shank taper has at least one recess for a positive reception of a locking element of a honing spindle and at least one inclined surface.

15. The honing tool according to claim 14, wherein the recess is a circumferential notch.

16. The honing tool according to claim 13, wherein the compression member is provided in an end region remote from the cutting material body with at least one recess for the positive reception of a coupling body associated with the honing spindle.

17. A method for coupling a honing tool to a honing spindle comprising the steps of:

inserting the honing tool in the honing spindle in a joining position where the honing tool center axis is oriented coaxially to the honing spindle center axis, and locking the honing tool on the honing spindle by actuating an adjusting device associated with the honing spindle, wherein the step of locking the honing tool on the honing spindle includes coupling a feed member of the honing spindle to a compression member of the honing tool, and wherein the locking of the honing tool to the honing spindle and the coupling of the feed member to the compression member are brought about by a single operating movement of the feed member in the direction of the honing tool.

* * * * *